United States Patent [19]

Sweeny et al.

[11] Patent Number: 4,730,378

[45] Date of Patent: Mar. 15, 1988

[54] APPLICATOR TOOL

[75] Inventors: Henry D. Sweeny, Kitchener; Antonio D. Sabbadin, Waterloo, both of Canada

[73] Assignee: Swenco Limited, Ontario, Canada

[21] Appl. No.: 12,906

[22] Filed: Feb. 5, 1987

[51] Int. Cl.[4] ..... B25B 27/14

[52] U.S. Cl. ..... 29/278; 140/109

[58] Field of Search ..... 81/488; 29/270, 278, 29/235, 238, 239, 243.5; 140/107, 109

[56] References Cited

U.S. PATENT DOCUMENTS 2,661,487 12/1953 Hicks et al. ..... 29/270

4,241,487 12/1980 Kraver ..... 29/278

*Primary Examiner*—Roscoe V. Parker

*Attorney, Agent, or Firm*—Jones, Tullar & Cooper

[57] ABSTRACT

An integrally moulded device for applying pressure to screen material or a retaining bead, to force same into a groove of a frame member is disclosed. The tool has a central body graspable by the human hand and a thin blade member at each end, each blade member having a straight edge surface extending from the body and a convexly arcuate edge surface extending from the outer end of the straight edge surface back to the body. One arcuate edge surface is transversely rounded for preforming screen material into the groove. The other arcuate edge surface is transversely V-shaped for pushing a flexible bead into the groove to retain the screen material therein. The shape of the blade members permits the application of pressure completely into corners defined by abutting grooves.

5 Claims, 15 Drawing Figures

APPLICATOR TOOL

This invention relates to an applicator tool, particularly one used to apply a bead of flexible material into a groove when repairing or manufacturing a window screen.

BACKGROUND OF THE INVENTION

A window screen typically involves a sheet of mesh material, often moulded from a flexible plastics material, a frame and means for affixing the mesh material to the frame. The affixing means usually involves a bead of flexible retaining material which is forced into a groove in the face of the frame along with the screen material. The flexible material exerts an outward pressure on the screen material to hold it securely in the groove.

When it becomes necessary to repair the screen, the bead is pulled from the groove and the screen material is lifted from the frame. New screen material is laid over the frame, pushed into the groove with a tool and then a new bead is forced into the groove by using another tool so as to stretch the screen material and to affix it to the frame.

In the past the tool used to affix the bead to the groove, or to initially push the screen material into the groove, has included a straight handle and a thin circular roller wheel. As the tool is moved along the groove the wheel rotates and with sufficient downward pressure it will force the screen material or the bead and screen material into the groove. A tool for just pushing screen material into the groove can have a transversely rounded edge and the tool for pushing the bead into the groove can have a transversely V-shaped edge.

Such a tool has two major drawbacks. It is expensive to manufacture, comprising several components, and it cannot reach into the corners where grooves of abutting frame members meet. This latter problem has necessitated the use of other tools, such as screwdrivers to ensure proper assembly at the corners.

SUMMARY OF THE INVENTION

The present invention overcomes the problems of the prior art by providing an applicator tool that is simple and inexpensive to manufacture, being an integrally moulded tool, and that is designed so that it will reach into corners, removing the necessity of using additional tools.

The present invention has an elongate narrow body which is smooth and comfortable to handle, and at each end it has a narrower blade member projecting from the body. Each blade member has a straight edge extending from the body and a curved edge that extends from the outer end of the straight edge back to the body. One curved edge is transversely rounded and the other curved edge is transversely V-shaped. The material of the tool is chosen for its low friction and strength properties (i.e., polypropylene) as well as for its cost. The shape of the blade members permits the application of downward pressure into the groove corners. The rounded edge is used to push screen material into the groove and the V-shaped edge is used to push the bead into the groove after the roundedged member has been used.

Broadly speaking, therefore, the present invention provides a device for pushing a flexible material into a retaining groove for capture therein comprising: a central body member graspable by a human hand; a first thin blade member at one end of the body member and a second thin blade member at the other end of the body member; each of the blade members including a straight edge surface extending outwardly from the body member and a convexly arcuate edge surface extending from the outer end of the straight surface back to the body member, the arcuate edge surface of the first blade member being transversely rounded and the arcuate edge surface of the second blade member being transversely V-shaped.

DESCRIPTION OF THE PREFERRED EMBODIMENTS

Figure 1:
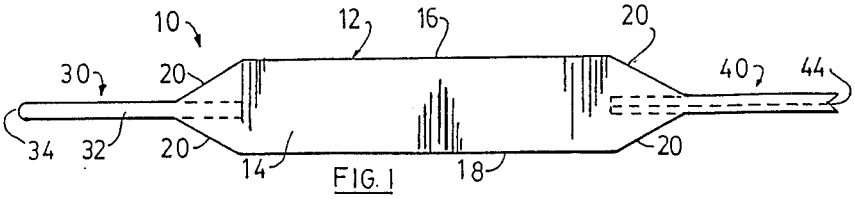
FIG. 1 shows a plan view of a screen applicator according to a first embodiment of this invention.
Figure 2:
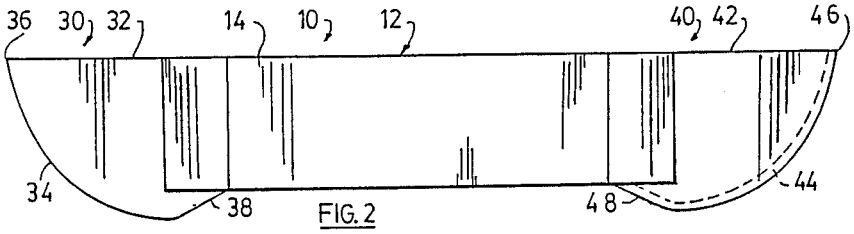
FIGS. 2 to 5 show, respectively, elevation, bottom, left end and right end views of the first embodiment.
Figure 3:
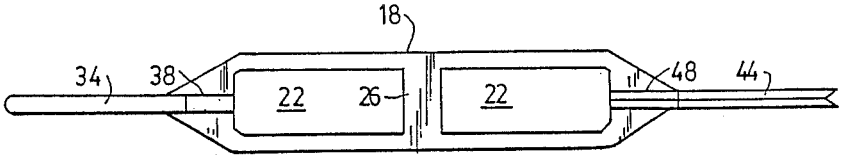

FIGS. 1 to 5 illustrate a first embodiment 10 of the applicator device according to this invention. The device includes, first of all, a central body 12 which has width, depth and length dimensions such that it can be readily and comfortably grasped by a human hand. Typical dimensions might be: width-$\frac{3}{4}$"; depth-1"; length-4". The central body 12 has a flat long edge surface 14, flat side surfaces 16,18 and converging end surfaces 20,20 at each end thereof. Since the device 10 is economically moulded from a low friction material such as polypropylene, filled nylon or any other suitable plastic material it is desirable to provide hollow cavities 22 extending into the central body 12 and separated by a web 26, to reduce the amount of material used and to ensure uniform cooling and curing after moulding.

Figure 4:
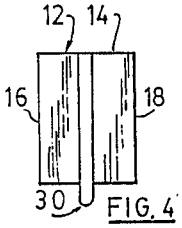
Figure 5:
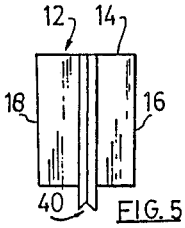

An integrally moulded first blade member 30 extends from one end of the central body and includes a straight edge surface 32 which is coextensive with the top surface 14 of the central body 12. The blade member is thin in comparison to the width of the central body, being about 1/6 of that width and it is provided with a convexly arcuate, transversely rounded edge surface 34 which curves away from the free end 36 of surface 32 back towards the central body 12. As seen in FIGS. 1, 4 and 5 the blade member 30 has a depth greater than that of the central body 12, the arcuate edge 34 terminating at a straight, transversely rounded, edge surface 38 which returns to the central body 12.

An integrally moulded second blade member 40 extends from the other end of the central body 12 and includes a straight edge surface 42 which is coextensive with the top surface 14 of the central body. The second blade member is the same width as the first blade member and has a convexly arcuate, transversely V-shaped edge surface 44 which curves away from the free end 46 of the edge surface 32 back towards the central body 12. The blade member 40 also has a depth greater than that of the central body 12, the arcuate edge 44 terminating at a straight, transversely V-shaped edge surface 48 which returns to the central body 12.

Figure 6:
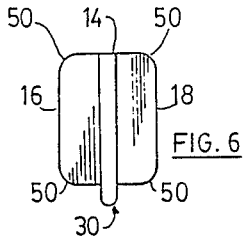
FIGS. 6 and 7 show, respectively, left end and right end views of a second embodiment of this invention.
Figure 7:
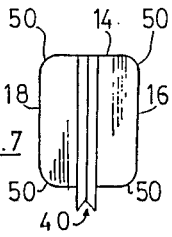
Figure 8:
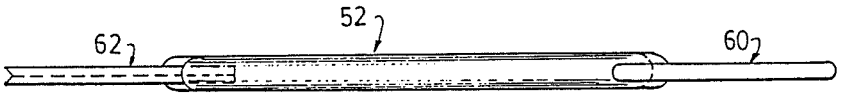
FIG. 8 shows a plan view of a screen applicator according to a third embodiment of this invention.

The embodiment shown in FIGS. 6 and 7 is identical to that of FIGS. 1 to 5 with the exception that it has rounded corners 50 at the junctions of the top, side and bottom surfaces of the central body 12 to improve the comfort while the device is being held by a human hand.

The embodiment of FIGS. 8 to 11 is perhaps the most preferable in that it is the most comfortable to use. In this embodiment the device 52 has a solid, thin central body 54 having transversely rounded top and bottom long edge surfaces 56,58 respectively. The central body of this embodiment is about 5/16" wide in comparison to the width of about ¾" for the first two embodiments.

Figure 9:
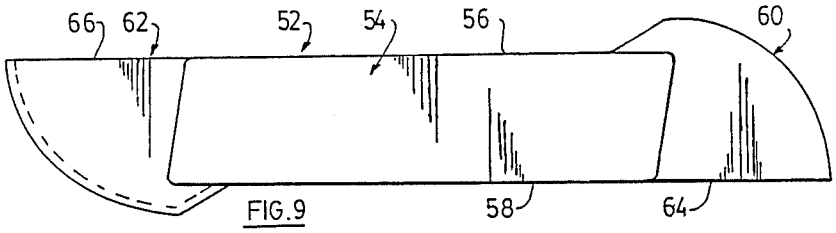
FIGS. 9 to 11 show, respectively, elevation, left end and right end views of the third embodiment.
Figure 10:
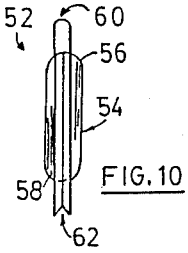
Figure 11:
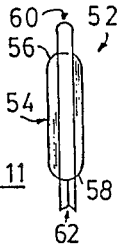

First and second blade members 60 and 62 extend from opposite ends of the central body. Blade members 60 and 62 are identical in shape to round-edged and V-edged blade members 30 and 40 respectively and do not require further description. However, it will be seen that while the straight edge surfaces 32 and 42 of the blade members 30 and 40 respectively were coextensive with the same long edge surface of the central body 12, the straight edge surfaces 64 and 66 of the blade members 60 and 62 respectively are each coextensive with a different long edge, 58 and 56 respectively, of the central body 54. Thus as seen in FIG. 9, in contrast to FIG. 2, the blade members 60,62 project beyond the two edges 56,58 respectively rather than beyond the bottom edge only of the central body. The embodiment of FIGS. 9 to 11 will be somewhat more economical to produce and will be more comfortable in use, being easier to handle, with the blade members having a lesser tendency to dig into the palm of the user's hand when he applies pressure to the device.

OPERATION

As previously indicated the device of this invention is to be used to apply or push elongated flexible material into a retaining groove. In particular it is very useful when one is repairing a window screen and has to force an elongated retaining bead and a portion of the screen material into a retaining groove of the screen frame. The invention is particularly beneficial in that its unique shape makes it possible to apply pressure to the retaining bead all the way into a corner of the frame, something that cannot be done with roller-type applicators.

FIGS. 12 to 15 illustrate the manner in which the applicator of this invention would be utilized in a typical screen repair situation. In these figures the screen material is identified by reference number 68; the frame member to which the screen material is to be secured is identified by reference number 70; the retaining groove in the frame member is identified by reference number 72; and the elongated, flexible retaining member or bead is identified by reference number 74.

Figure 12:
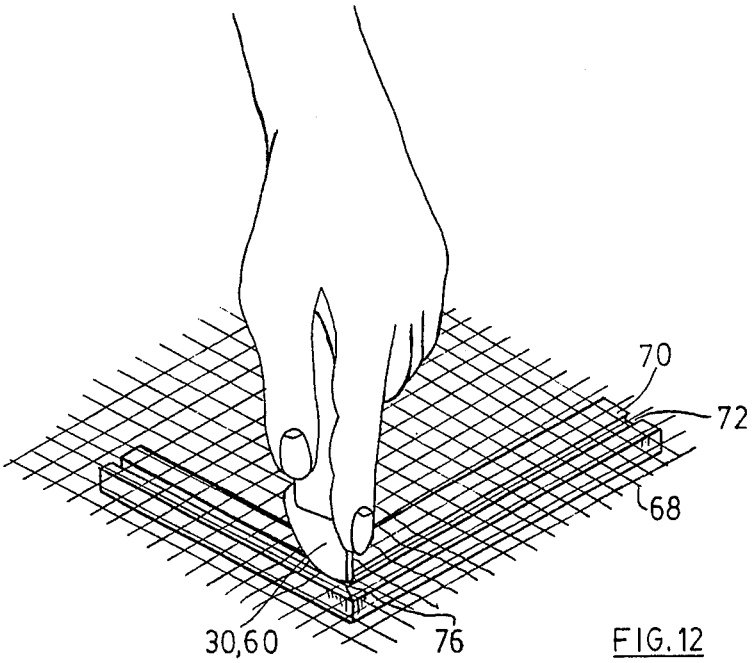
FIGS. 12 to 15 show the manner in which the applicator of the invention is utilized.
Figure 13A:
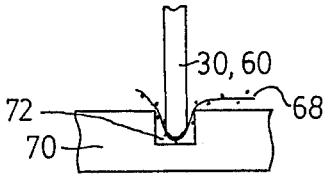
Figure 13:
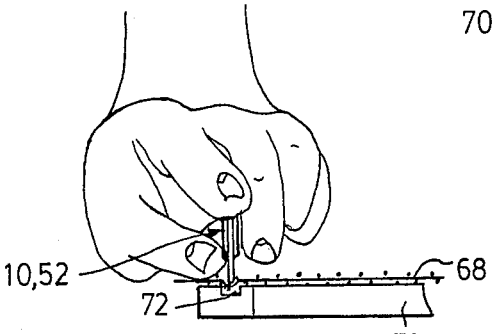

With reference to FIG. 12, the screen material 68 is laid over the frame members 70 and, using the round-edged blade member 30 or 60 of the applicator pressure is applied to the screen material to push it into the grooves 72 as seen in FIGS. 13 and 13A. As shown in FIG. 12 it is possible to use the applicator right into the corner 76, thereby stretching the screen material completely.

Figure 15:
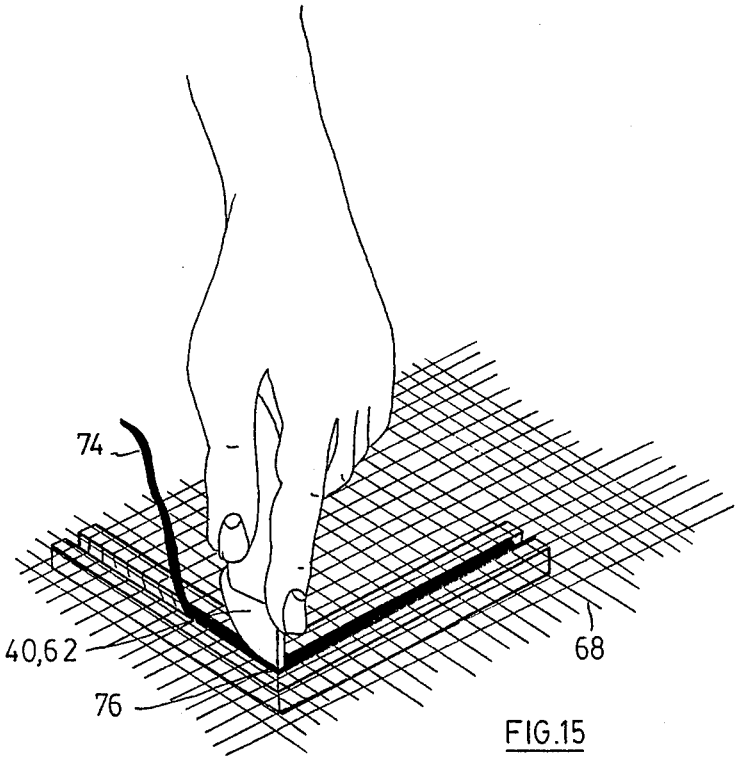
Figure 14:
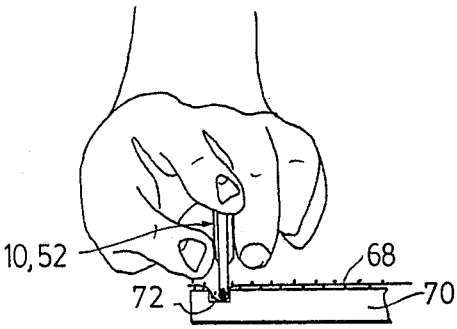
Figure 14A:
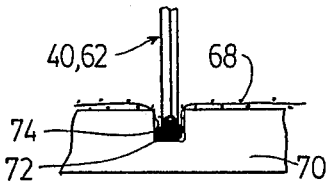

After the preliminary pushing of the screen material 68 into the grooves 72 it is necessary to force the flexible retaining bead or member 74 into the grooves. This is accomplished with the V-edged blade member 40 or 62 as shown in FIGS. 14 and 14A. The V-edge mates with the flexible member 74 and with the application of downward pressure the flexible member 74 is forced into the groove 72 on top of the previously formed screen material. The outward pressure exerted by the flexible member 74 on the screen material serves to retain the screen material in the grooves 72. As seen in FIG. 15 it is possible to ensure that the flexible material is completely captured by the grooves at the corner 76.

The applicator of this invention is economical to produce and is effective in applying flexible material to the grooves of a window screen as indicated herein. Such an applicator could even be included as a component of a screen repair kit, along with screen material and suitable flexible retaining material, such as might be sold to the home handyman.

It is conceivable that a person skilled in the art might be able to effect changes to the invention without departing from the spirit thereof. Thus the protection to be afforded this invention is to be determined from the claims appended hereto.

The embodiments of the invention in which an exclusive property or privilege is claimed are defined as follows:

1. A device for pushing a flexible material into a retaining groove for capture therein comprising: a central body member graspable by a human hand; a first thin blade member at one end of said body member and a second thin blade member at the other end of said body member; each of said blade members including a straight edge surface extending outwardly from adjacent one longitudinal edge of said body member and a convexly arcuate edge surface extending from adjacent the other longitudinal edge of said body member to the outer end of said straight edge surface and defining a sharp corner therewith, the arcuate edge surface of the first blade member being transversely rounded and the arcuate edge surface of said second blade member being transversely V-shaped.

2. The device of claim 1 wherein the straight edge surface of each of said blade members is coextensive with the same longitudinal edge of said body member.

3. The device of clim 1 wherein the straight edge surface of each of said blade members is coextensive with a different longitudinal edge of said body member.

4. The device of claim 1, wherein each blade member has a depth greater than the depth of said central body member.

5. The device of claim 1, wherein said body member and said blade members are integrally moulded from a low friction plastics material.

* * * * *